United States Patent [19]

Seufert

[11] Patent Number: 5,031,826

[45] Date of Patent: Jul. 16, 1991

[54] ROUND CONTAINER INTENDED FOR DISPATCH IN THE EMPTY STATE AND METHOD OF MAKING SAME

[76] Inventor: Thorsten Seufert, 6056 Heusenstamm, Im Rehwinkel 11, Fed. Rep. of Germany

[21] Appl. No.: 478,651

[22] Filed: Feb. 9, 1990

[30] Foreign Application Priority Data

Feb. 10, 1989 [DE] Fed. Rep. of Germany ..... 3903980

[51] Int. Cl.[5] ..... B65D 5/42

[52] U.S. Cl. ..... 229/162; 206/45.34

[58] Field of Search ..... 229/162, 4.5; 220/82 R; 206/45.31, 45.34

[56] References Cited

U.S. PATENT DOCUMENTS

| | | | |
|---|---|---|---|
| 2,164,354 | 7/1939 | Schrier | 206/45.34 |
| 2,172,864 | 9/1939 | Calva et al. . | |
| 2,189,955 | 2/1940 | Hokerk | 229/162 |
| 2,226,340 | 12/1940 | Flood . | |
| 2,551,090 | 5/1951 | Bergstein | 229/162 |
| 3,199,670 | 8/1965 | Palmer | 206/45.34 |
| 3,400,878 | 9/1968 | Heller, Jr. et al. | 229/162 |
| 3,487,991 | 1/1970 | Stern | 229/162 |
| 3,746,242 | 7/1973 | Troth | 229/162 |
| 4,733,916 | 3/1988 | Seufert | 229/162 |
| 4,826,004 | 5/1989 | Dupuy | 229/162 |

FOREIGN PATENT DOCUMENTS

| | | | |
|---|---|---|---|
| 517132 | 1/1931 | Fed. Rep. of Germany . | |
| 1881473 | 8/1963 | Fed. Rep. of Germany . | |
| 1980163 | 4/1964 | Fed. Rep. of Germany . | |
| 7535138 | 4/1976 | Fed. Rep. of Germany . | |
| 7635125 | 4/1977 | Fed. Rep. of Germany . | |
| 3121664 | 12/1982 | Fed. Rep. of Germany . | |
| 3523416 | 1/1987 | Fed. Rep. of Germany . | |
| 8711169 | 12/1987 | Fed. Rep. of Germany . | |
| 908739 | 4/1946 | France . | |
| 1137975 | 6/1957 | France . | |
| 393729 | 6/1933 | United Kingdom | 229/162 |
| 2074124 | 10/1981 | United Kingdom . | |

*Primary Examiner*—Gary E. Elkins

*Attorney, Agent, or Firm*—Toren, McGeady & Associates

[57] ABSTRACT

A round container which is intended for dispatch in the empty state possesses a side wall and at least one closure wall, sealingly and firmly inset into the side wall at an angle to it, which closure wall is for example a base. The side wall consists at least partly of a transparent sheet part having a thickness of 130 to 500 μm. To enable a part of the side wall to be printed in an appealing form and the intrinsic stiffness of the round container to be improved in spite of the viewing facility provided, the edge of the side wall towards the closure wall is formed, around the periphery, at least partly as cardboard part from a cardboard material having a weight per unit area of at least 150 g/m², sheet part and cardboard part not overlapping each other in a partial region serving as viewing opening. Furthermore, the transparent sheet part extends, at least a portion of the periphery, as far as the edge of the side wall remote from the closure wall and is of a single-layer, hard transparent sheet, preferably free of plasticizer or having low plasticizer content, which possesses the aforementioned thickness of 130 to 500 μm and, finally, the transparent sheet part and the cardboard part overlap each other at the edge of the viewing opening within the side wall and are firmly connected together in the overlap zone.

17 Claims, 3 Drawing Sheets

FIG. 1
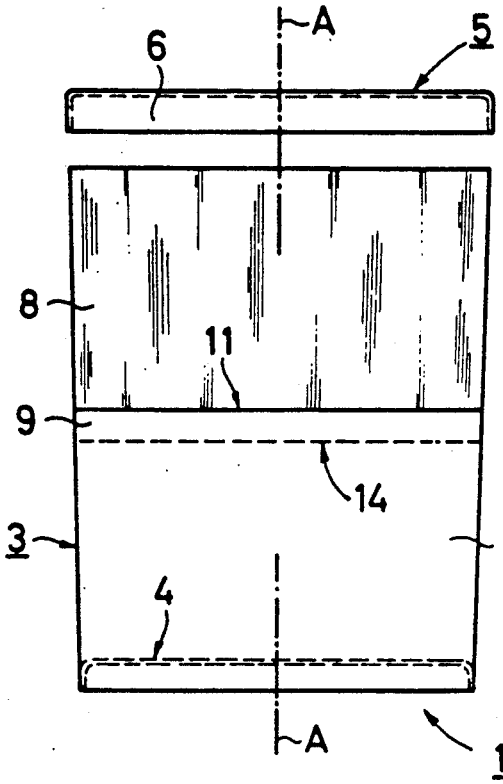
FIG. 2
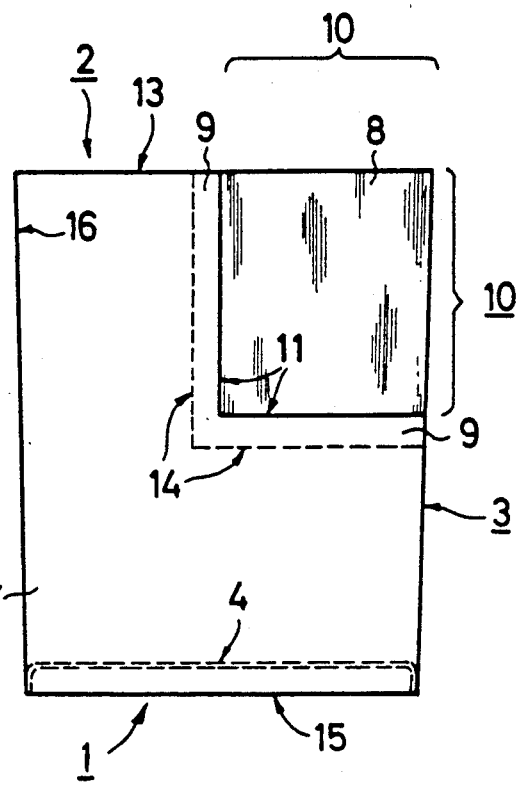
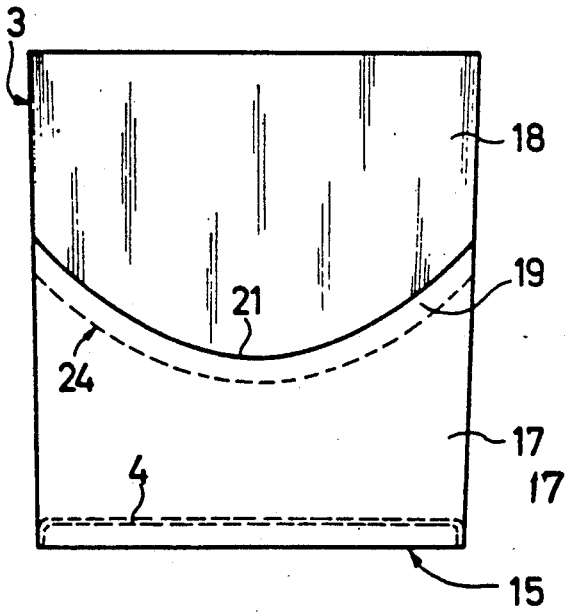
FIG. 3
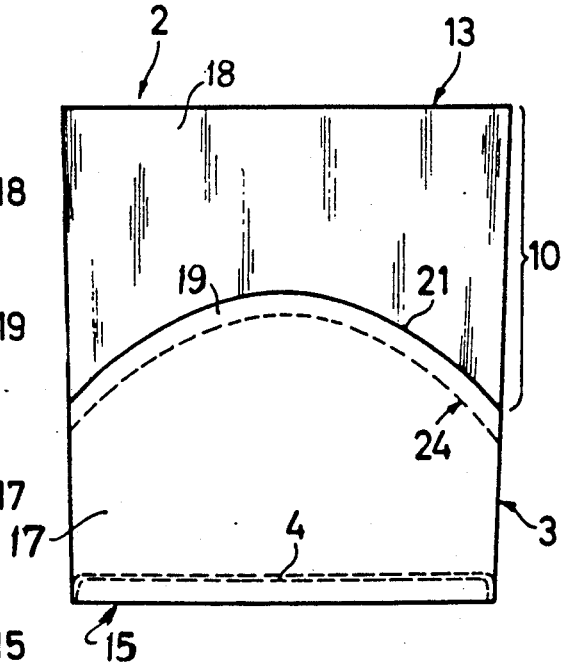
FIG. 4

FIG. 8
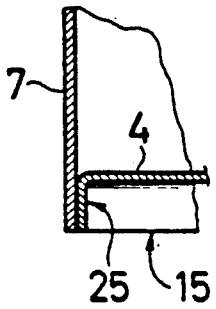
FIG. 9
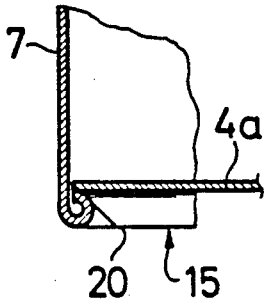
FIG. 10
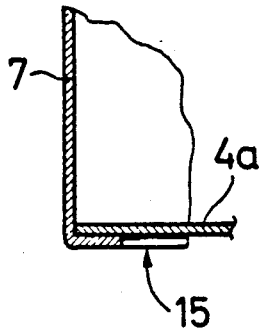
FIG. 11
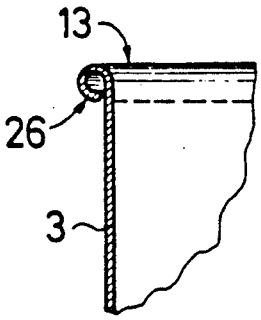
FIG. 12
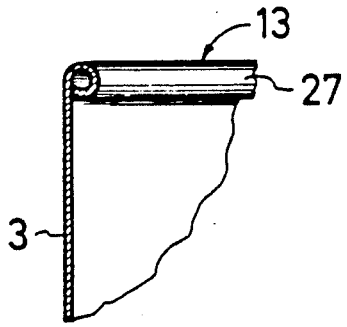
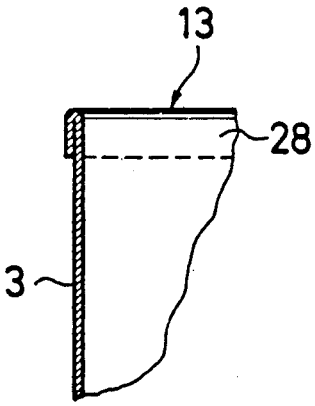
FIG. 13
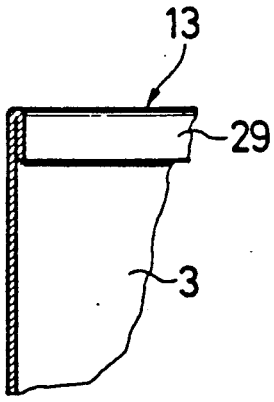
FIG. 14

ROUND CONTAINER INTENDED FOR DISPATCH IN THE EMPTY STATE AND METHOD OF MAKING SAME

FIELD OF THE INVENTION

This invention relates to a round container intended for dispatch in the empty state, comprising a side wall and at least one closure wall, extending at an angle to the side wall and sealingly and firmly inset into the side wall, wherein the side wall consists at least partly of a transparent sheet part having a thickness of 130 to 500 μm.

DESCRIPTION OF THE PRIOR ART

"Round containers" of this type enjoy great popularity for numerous applications, such as for example biscuits, sweets and gifts of all types.

Round containers are made either of cardboard or thick paper or of plastics sheet in different sizes and diameter/height ratios. They consist of a cylindrical or slightly conical side wall and of a circular or oval base, inserted and fixed in various ways. As a rule, the upper opening can be closed by a lid placed on or in it.

Round containers of cardboard or thick paper may, due to the material properties and as a function of the material thickness, be very stable and retain their shape even under considerable internal loading due to packed or filled-in goods. They do not, however, directly permit observation of the goods packed or filled into them, because their cylindrical wall is opaque. Only after the lid has been removed can the contents of the container be inspected, and then only from the top. Containers of paper or cardboard can, indeed, be printed and/or labelled on the outer face of the cylindrical wall, but only indirect information about the condition and appearance of the contents can be obtained from such an external configuration of the round container. But sensitive goods, especially foods, are the very ones for which opening of the container must be forbidden, for reasons of possible damage or adverse influence upon hygiene.

It is also known, to make round containers completely of transparent plastics sheet. These round containers are, however, usually undesirably flexible and of low stability of shape, even where the sheet thickness is considerable, especially when they are filled with heavy articles. In spite of their advantage of permitting observation of the contents from several sides without opening of the container, they do not offer adequate protection for heavy and/or sensitive articles. In some of these round containers, the base is simply laid loosely on the inwardly beaded, lower edge of the side wall, so that a pronounced weakness exists at this point and there is a risk of penetration of dust.

From DE-U 8 711 169, a gastight and liquid-tight container pack is known which, however, can only be dispatched in the filled state, i.e. with contents. To make it possible to look inside, a window is inserted in the side wall in the form of a transparent plastics sheet, by the plastics sheet abutting against the core material of the remaining side wall. To achieve the necessary tightness to gas and liquid, the side wall abutting the transparent sheet must be multi-layer, i.e. made of composite material, the so-called core material being sandwiches between an inner and an outer cover, which at least partly overlap or fit over the plastics sheet abutting the core material, and least in its edge zone. Such a composite material is very expensive, and the insertion of the plastics sheet forming the window is complicated and requires high capital investment. In spite of the overlap in the region of the outer and inner covers, a location of weakness exists in the region of the butt joint between transparent plastics sheet and core material, so that the finished, filled container only obtains its strength by a base and a lid both engaging into the side wall, the so-called trunk, and being connected gastight to it.

This known container pack is nothing other than an expensive replacement for the known food can, and is not suitable for inexpensive applications, in which absolute tightness against gases and liquids is not of prime importance, but for which the possibility of dispatch in the empty state is the main consideration.

From FR-A 1 137 975, a container not belonging to this category is known, in which a window injection moulded of transparent plastics is inserted in a trunk of sheet metal. For the purpose of connecting this window to the window cut-out in the container trunk, the window itself is equipped with a peripheral rib which, after thermal softening, is flanged over around the edge of the window or is glued to it. Neither the method of manufacture nor the pack itself are suitable for mass application.

From U.S. Pat. No. 2,172,864, again, a liquid container is known, into which windows are inserted, preferably on diametrically opposite sides. The insertion of the windows is done either through the intermediary of special frames of sheet metal or plastics, or a laminate must be used, a transparent sheet being embedded between the outermost sheets, which possess congruent window openings. Since the foil window in the last-named case constitutes a pronounced location of weakness and does not possess any self-supporting properties, the described principle of construction can be used also only for relatively small windows.

DE-U- 7 535 138 discloses a container of cylindrical form. The cardboard part is of two-layer construction, congruent windows being disposed in the two layers and the sheet being disposed between the cardboard layers. The sheet constitutes a pronounced location of weakness in the remaining construction, so that against the size of the window is relatively small. The transparent sheet window is, consequently, in no way mechanically equivalent to the cardboard part and also does not permit adequate inspection into the dark interior of the container.

DE-C 517 132 discloses a vessel having a viewing opening, which is initially closed by cardboard. The periphery of the window is established only by a perforation line, through which the window can afterwards (during use) be opened.

Once the dummy pack has been shown to an interested person, the pack is "broached". From the fact that the "window shutter" is fitted at all, it follows that the strength properties of the window are very limited.

From FR-A- 908 739, it is known to assemble bag-shaped containers in cylindrical form from paper and transparent sheet. It is stated that the sheet is clearly weaker than the paper and that if the window size exceeds a certain dimension, the sheet window must be reinforced by stiffening strips at the edge or the edges.

DE-U- 1 881 473 discloses a folding box of a different category having a sheet window. The window sheet is to be, for example, of cellophane. If the field of view extends over one full side of the folding box, this field of view may advantageously be divided by ribs. These ribs of the cardboard material divide the total viewing field into several individual windows and at the same time ensure that a considerable reduction in the strength of the folding box is avoided.

It is known, moreover, that the sheet material used for round containers is difficult to print on, especially with the degree of fineness that is possible for paper and cardboard. Printing inks for sheet material furthermore contain solvent, so that if the internal surfaces are printed food-stuffs may be endangered, while if the outer surfaces are printed there is a risk of scratching. For unprinted side walls consisting entirely of transparent foil, the remedy has hitherto therefore been either to print an only loosely inserted cardboard base, so that the legend cannot be read without raising the round container, or to place a printed paper strip behind the lower zone of the side wall. This strip can, however, slip; furthermore it does not stiffen the sheet material.

An objective of the present invention therefore is to provide a round container of the initially described category, which can be printed on a part of its side wall in an appealing form, possesses good intrinsic stiffness so that it can be dispatched even in the empty state, and which makes possible viewing of the interior of the container.

SUMMARY OF THE INVENTION

According to one aspect of the present invention, there is provided a round container intended for dispatch in the empty state, comprising a side wall and at least one closure wall, extending at an angle to the side wall and sealingly and firmly set into the side wall, wherein the side wall consists at least partly of a transparent sheet part having a thickness of 130 to 500 μm, wherein a) the edge of the side wall towards the closure wall is formed, around the periphery, at least partly as a cardboard part from a cardboard material having a weight per unit area of at least 150 g/m$^2$, the sheet part and cardboard part not overlapping each other in a region serving as a viewing opening, b) the transparent sheet part extends, on at least a part of the periphery, to the edge of the side wall remote from the closure wall and is of a single-layer, hard transparent sheet, preferably free of plasticizer or having low plasticizer content, the radius of curvature of which corresponds to that radius of curvature which the complete round container possesses in the horizontal plane under consideration and which possesses the aforementioned thickness of 130 to 500 μm, and c) the transparent sheet part and the cardboard part overlap each other at the edge of the viewing opening within the side wall and are firmly bonded to each other in the overlap zones.

The individual features mingle with and promote one another in the sense of creating an extraordinarily stable but nevertheless inexpensive packing container, which can be printed upon in the region of the side wall on the outer face and possesses a clear, transparent viewing opening of large area.

Compared with a packing container constructed in composite manner as a folding box, the round container constructed in composite manner possesses excellent stiffness simply by virtue of the curvature of the side wall, this stiffness being also conditioned by the firmly inserted closure wall. This closure wall may constitute both the lid and also the base of the round container, because this is a question of the position of use for which the round container is intended. Thus, for example, the lid, fitted on later, may in the position of use constitute the standing surface of the round container, i.e. its "base".

The round container according to this invention differs also from those round containers which are provided only with a glued-on or inserted label of thin paper. As a result of the stated lower limit of the weight per unit area, an intrinsic stiffness also of the cardboard part is achieved.

Solvent-free printing inks may be used for printing the cardboard part.

If, in the course of a further embodiment, the lower edge of the side wall is formed exclusively of the cardboard material, not only is a corresponding saving in material in the sheet part achieved, but also the lower edge, consisting entirely of the cardboard material, can be very easily further processed and connected with the closure wall. Thus, for example, the cardboard material can be very much more rapidly and easily rolled over, folded or flanged on machines intended for this purpose, but in particular without the heating necessary for plastics sheets, in order to make possible the preparations for the insertion and fixing of the closure wall (e.g. the base).

In total, the result is achieved that the entire, assembled side wall basically possesses the same mechanical strength, so that a preferential inward buckling or inward kinking does not occur in the region of one part of the side wall.

By feature c), the result is achieved that the connection point between sheet part and cardboard part produces a stiffening, because a very much greater wall thickness is present at this position, which possesses more than twice the strength against inward buckling. This effect is particularly advantageous if the connecting location extends circumferentially around at least a part of the round container, as is the case in the example of embodiment according to FIGS. 3 and 4.

The firm connection between cardboard part and sheet part can be effected by gluing, welding (sealing) or other suitable measures. The term "welding (sealing)" is to be understood also as a connecting technique using ultrasonics. In every case the overlap and connecting position is a stiffening element for the round container, both for the empty and also the filled state of the container. The round container therefore obtains its special strength before the firm connection of the trunk with base and lid.

It is especially advantageous if the packing container is constructed with the round container diverging slightly conically towards its opening in such a manner that several round containers can be inserted and stacked inside one another.

In such a case, the blank of the side wall has the form of the wall of a truncated cone, i.e. of an annular sector. By the insertion one into another of several round containers, not only is considerable space saved for transporting in the empty condition, but the containers stiffen one another against inward compression and upsetting.

The cardboard material of the cardboard part preferably has a weight per unit area of between 150 and 1,000 g/m$^2$, the value not being allowed to fall below the lower limit of this range within the concept of this invention. The actual weight per unit area depends upon the volume of the round container, the larger weight per unit area being associated with the larger volume of container. The cardboard part can also, with particular advantage, be of corrugated cardboard, which as is well known possesses very great strength.

For the sheet part, in contrast, transparent sheets in the form of film foils having a thickness of 130 to 500 μm may be used with especial advantage. Here again the fundamental rule applies that the greater wall thickness is to associated with the greater volume of container. Useful results have, however, already been obtained with wall thickness between 130 and 300 μm. The sheet is, with particular advantage, a single-layer, so-called hard sheet, for example of PVC, which is at least low in plasticizer but with particular advantage is completely free of plasticizer.

According to another aspect of the present invention, there is provided a method of making a round container essentially according to the first aspect of the invention, the method being such that prefabricated individual blanks of at least one cardboard part and of at least one sheet part are firmly connected to each other in the region of the at least one section edge of the future viewing opening in the flat state and partly overlapping each other in an overlap zone to form a composite blank, then the side wall is cut out from the composite blank and, finally, the side wall blank is rolled round to form the side wall and is connected along a seam position.

By this method of manufacture, the subject of the present invention differs in a quite especially advantageous manner from the state of the art, in which the combination of the cardboard part or part of another material for the container trunk, and of the transparent "window", can be produced only on the already largely completed container trunk, as for example is the case in the subject according to FR-B 1 137 975 and the majority of the examples according to U.S. Pat. No. 2,172,864, in which the bonded connection between window and opaque part of the container trunk can no longer be deformed afterwards.

DE-U 87 11 169 states, as manufacturing method for the trunk, that the composite material is processed either as blanks or in the winding method to form the trunk, but as a rule must be *pressed* into the desired shape. This extravagance must be adopted because this known container trunk must be gastight and liquid-tight, but in particular must have the appearance of a conventional food can.

BRIEF DESCRIPTION OF THE DRAWINGS

For a better understanding of the invention and to show how the same may be carried into effect, reference will now be made, by way of example, to the accompanying drawings, in which:

FIGS. 1 and 2 show a round container with a "window" which extends around a periphery of 180°, in front and side views, FIGS. 3 and 4 show a further, differently formed round container, in which the sheet part extends around the entire periphery, in front and side views, FIGS. 8, 9 and 10 show partly radial sections of differently formed connection points between side wall and base, and FIGS. 11, 12, 13 and 14 show partly radial sections through different forms of construction of the upper edge of the container.

DESCRIPTION OF THE PREFERRED EMBODIMENTS

Figure 5:
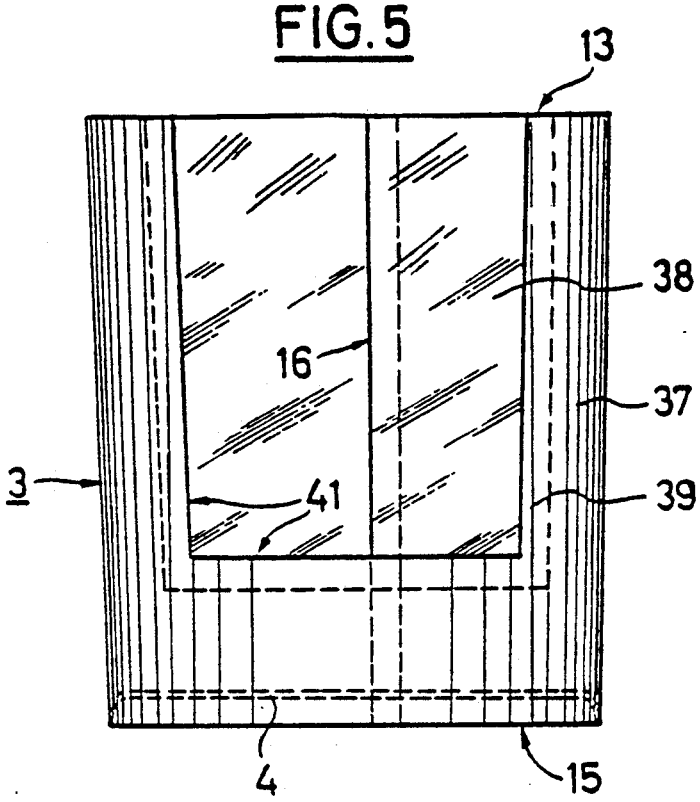
FIG. 5 shows a round container in front view, with a "window" which extends around only a part of the circumference of the side wall, but at the same time is at a distance from the lower edge of the side wall.

The round container 1, illustrated in FIGS. 1 and 2, which is formed slightly conically diverging towards its opening 2, consists of a side wall 3, which is wrapped around an imaginary axis A—A, a closure wall extending radially or perpendicularly to this axis, which in the present case is formed as base 4, and of a fit-on lid 5 having a rim 6, by which the lid can be seated on the side wall, overlapping the upper edge of the container.

The side wall consists, in this example of embodiment, of a cardboard part 7 continuous over the entire height of the round container 1, which is firmly connected with a transparent sheet part 8. The cardboard part and sheet part are inseparably connected together in a U-shaped overlap zone 9, by gluing and/or welding (sealing). The non-overlapping zone 10 constitutes the so-called viewing opening or "window". The U-shaped section edge 11 of the cardboard part 7, bounding the viewing opening, extends as far as the circular edge 13 of the side wall 3 constituting the opening 2. The sheet part 8 is also limited by section edges 14 which, however, are masked by the cardboard part 7. Between the section edges 11 and 14 lies the overlap zone 9 stiffening the side wall.

It can be seen that the sheet part 8, starting from the upper edge 13, extends through only about half the height and half the circumference of the side wall, and therefore makes up about one quarter of the area of the side wall 3. Nevertheless, the sheet part 8 does not constitute a weakened zone, because it can be just as heavily loaded as the cardboard part 7, a mutual stiffening occurring in the overlap region 9. The cardboard part 7 can be printed in an excellent manner by all conventional printing processes, so that an especially valuable impression can be visually created. It should be noted that this is possible without the round container according to this invention being provided with a label.

The side wall 3 furthermore possesses also a lower edge 15, in which the base 4 is inserted. Possible methods of fixing the base 4 in the side wall 3 are illustrated in detail in FIGS. 8, 9 and 10. In the present example of the embodiment the side wall 3 consists, in the region of its lower edge 15, i.e. at the connection location with the base 4, exclusively of the material of the cardboard part 7. The sheet part 8 therefore does not extend down into the region of the connection to the base 4. The unavoidable seam 16 of the side wall is located on the side of the round container remote from the sheet part 8.

In the example of embodiment according to FIGS. 3 and 4, the cardboard part 7 is not continued through the entire height of the side wall. Instead the cardboard part 17 has a section edge 21 which bounds the viewing opening and returns on itself at the periphery of the side wall 3. The section edge 21 may lie in a horizontal radial plane so that the visual impression given in FIG. 1 results. It is, however, possible with particular advantage to construct the section edge 21 undulating, as illustrated in FIGS. 3 and 4. As a consequence the height of the cardboard part 17 varies around the periphery of the round container. Apart from the overlap region 19, which is bounded at the bottom by the concealed section edge 24 of the sheet part 18, the sheet part has a complementary cut, i.e. here again the side wall consists, in the region of its lower edge 15, exclusively of the material of the cardboard part 17.

Since the side wall 3 has a cylindrical or conical surface, it already possesses considerable stiffness against upsetting forces which may act in a vertical direction. It also has sufficient stiffness against inward buckling or denting in a horizontal direction. In the example according to FIGS. 3 and 4 also, the stiffening of the cardboard part 17 and sheet part 18 in the overlap zone 19 leads to an additional stiffening, especially against inward buckling in a horizontal direction.

From a comparison of FIGS. 1 and 2, on the one hand, and FIGS. 3 and 4, on the other hand, it is evident that the section edges 11, 21 respectively may have almost any form, so the decorative effect of the round container can be influenced in various directions. From this possibility a large number of forms of container is possible. Although the cardboard part 7, 17 respectively of the round container is preferably printed, it is of course also possible to print the sheet part 8, 18 respectively by the methods usual for sheet printing.

The form of the lower edges 15 of the side walls 3 may also vary considerably. The following referencing of the parts of the round container relates to FIGS. 1 and 2; it will be understood, however, that instead of the references given those of FIGS. 3 and 4 could also be used.

FIG. 5 shows a further variant of a round container. In this case also the outwardly situated cardboard part 37 possesses a window which is bounded by a U-shaped section edge 41, the two "arms" of which extend to the upper edge 13. The seam 16 is on the opposite side; only that part of it lying behind the "window" is visible. The position of the window and section edges 41 has been so chosen that the lower portion of the section edge 41, running parallel to the edges 13 and 15, is at a distance from the edge 15 which is clearly smaller than one-half the height of the round container, so that a large "bright" window is formed. This results in a U-shaped overlap zone 39. In this case also the region directly above the lower edge 15 consists exclusively of the cardboard part.

Figure 6:
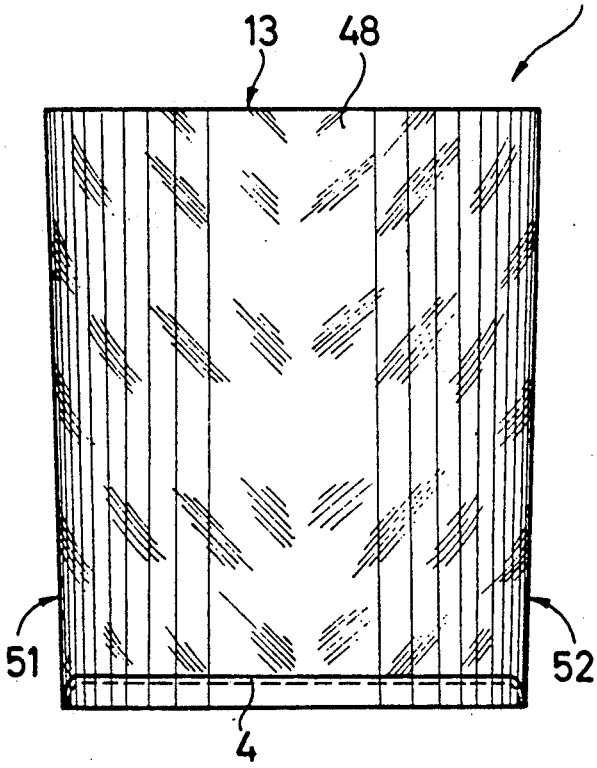
FIGS. 6 and 7 show a round container in front and side views, wherein cardboard and sheet parts alternate around the circumference and the section edges and also the window extend through the entire height of the round container.
Figure 7:
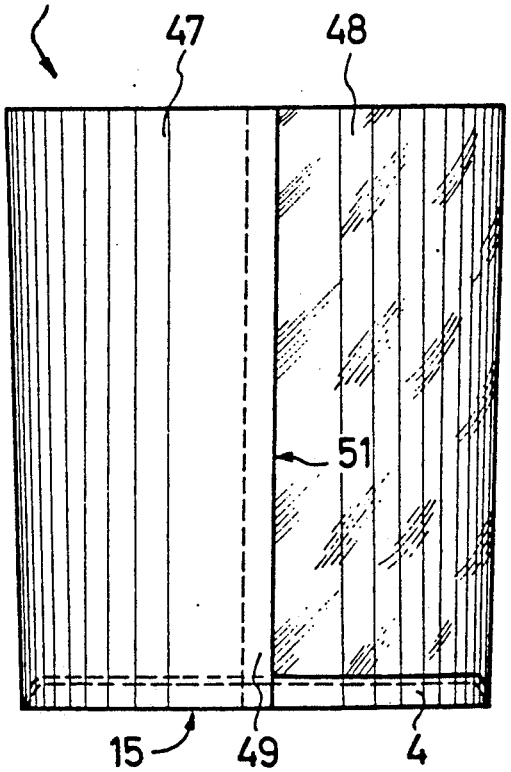

FIGS. 6 and 7 show a further variant, in which the "window" extends over the entire height of the side wall component 3, i.e. the upper and lower common section edges at the same time form the upper and lower edges 13, 15 respectively. As a consequence the side wall 3 possesses two further section edges 51 and 52, which extend between the upper edge 13 and lower edge 15. In this manner cardboard and sheet parts alternate around the periphery of the side wall 3. In this example of embodiment it is, of course, possible to dispense with a special, i.e. additional seam position 16, because one of the two overlap zones 49 additionally fulfils the function of the seam position 16.

In the example of embodiment according to FIG. 8, a base 4 is inset into the cardboard part 7, as already shown in broken lines in FIGS. 1 to 7. For this purpose, the base 4 possesses a downwardly orientated rim 25, by which it is firmly glued into the cardboard part 7, closed to a ring.

In the example of embodiment according to FIG. 9, the cardboard part 7 is rolled inwards to a beaded edge 20 at its lower edge 7, and the purely circular base **4*a* is glued at its edge from above onto the beaded edge 20**.

In the example of embodiment according to FIG. 10, the cardboard part 7 is cranked perpendicularly inwards and forms, at this location, a kind of annular flange 23, onto which an also circular base **4*a*** is glued. The fixing in all cases may also be effected by ultrasonic sealing.

The upper edge 13 of the side wall 3 may, of course, simply be trimmed off smooth, i.e. the individual generatrices are also exclusively linear in the upper region. It is, however, possible with particular advantage and for stiffening purposes to form the upper edge 13 in different ways, as illustrated by reference to FIGS. 11 to 14.

Care should of course be taken here to ensure that the stacking capability is, if necessary, retained.

In the example according to FIG. 11, the side wall 3 is rolled outwards at its upper edge 13 to form a beaded edge 26. If, in the region of the upper edge 13, cardboard parts 7 and sheet parts 8 alternate around the circumference (FIGS. 1 and 2), the beaded edge 26 will of course extend over the cardboard part as well as over the sheet part. In the case of an outwardly rolled beaded edge according to FIG. 11, the stacking capability is maintained also even with only slight conicity.

In the example according to FIG. 12, the sheet wall 3 is rolled inwardly to form a beaded edge 27 at its upper edge 13. In this case, stacking capability is obtained only with relatively large conicity of the side wall.

In the example according to FIG. 13, the side wall 3 is folded back outwards, flat, at its upper edge 13, i.e. the two sheet parts resting upon each other at this position touch each other along a narrow cylindrical surface 28.

In the example according to FIG. 14, the side wall 3 is folded over inwards at its upper edge 13 in an analogous manner, i.e. the two parts of the side wall resting on each other in this region touch each other along a narrow cylindrical surface 29, which in this case lies on the inner face of the side wall 3.

The base 4, **4*a* respectively and the lid 5 may be of widely differing materials: as material for this purpose, for example, thermoplastic sheet materials, cardboard and corrugated cardboard may be considered, which may be permanently or releasably connected by a wide variety of methods to the side wall 3 in the region of the lower edge 15. The lid 5** may also be injection moulded from a thermoplastics material. If an aroma protection is desired (e.g. for coffee), then laminated cardboard materials may be used.

A single-layer sheet should also be understood to include a material in which the two surface regions and the core region constitute an inseparable whole by co-extrusion or lamination during manufacture of the sheet. Thus, for example, the core region may be of a recycling material, and the surface regions of new material.

I claim:

1. A round container intended for dispatch in an empty state, comprising a side wall and at least one closure wall, extending at an angle to the side wall and sealingly and firmly set into the side wall, wherein the side wall consists at least partly of a transparent sheet part having a thickness of 130 to 500 $\mu$m, wherein a) a lower edge of the side wall towards the closure wall is formed, around the circumference of the side wall, at least partly as a cardboard part from a cardboard material having a weight per unit area of at least 150 g/m$^2$, the sheet part and cardboard part not overlapping each other in a region serving as a viewing opening, b) the transparent sheet part extends, on at least a part of the side wall circumference, to an upper edge of the side wall remote from the closure wall, which upper edge defines an upper opening, the transparent sheet part being a single-layer, hard transparent sheet having a radius of curvature that corresponds to a radius of curvature of the complete round container in a horizontal plane, and has the aforementioned thickness of 130 to 500 μm, and c) the transparent sheet part and the cardboard part overlap each other in zones at an edge of the viewing opening within the side wall and are firmly bonded to each other in the zones of overlap.

2. A round container according to claim 1, wherein the lower edge of the side wall consists exclusively of the cardboard material.

3. A round container according to claim 1, wherein the round container diverges slightly conically towards the upper opening so that several round containers are insertable and stackable inside one another.

4. A round container according to claim 1, wherein the cardboard part has at least one section edge that bounds the viewing opening, the at least one section edge extending as far as the upper edge of the side wall forming the upper opening.

5. A round container according to claim 1, wherein the cardboard part has at least one section edge that bounds the viewing opening, the at least one section edge being closed on itself at the circumference of the side wall.

6. A round container according to claim 1, wherein the cardboard part has at least two section edges which bound the viewing opening, the at least two section edges extending from the upper edge to the lower edge of the side wall.

7. A round container according to claim 1, wherein said closure wall is circular and disc-shaped and constitutes a base of the container.

8. A round container according to claim 7, wherein the base has an edge provided with a cranked rim, by which the base is glued to the lower edge of the side wall which is at least partly a cardboard part, and on an inner face of the side wall.

9. A round container according to claim 7, wherein the cardboard part of the side wall is rolled inwards to form a beaded edge at the lower edge, the base being laid from above onto the beaded edge.

10. A round container according to claim 1, wherein the cardboard part is of a cardboard material having a weight per unit area of from 150 to 1,000 g/m$^2$.

11. A round container according to claim 1, wherein the cardboard part is of corrugated cardboard.

12. A round container according to claim 1, wherein the side wall is rolled outwardly to form a beaded edge at the upper edge.

13. A round container according to claim 1, wherein the side wall is rolled inwardly to form a beaded edge at the upper edge.

14. A round container according to claim 1, wherein the side wall is outwardly folded over at the upper edge.

15. A round container according to claim 1, wherein the side wall is inwardly folded over at the upper edge.

16. A round container according to claim 1, wherein the hard transparent sheet is free of plasticizer.

17. A round container according to claim 1, wherein the hard transparent sheet has low plasticizer content.

* * * * *